US007545339B2

(12) United States Patent
Ratni et al.

(10) Patent No.: US 7,545,339 B2
(45) Date of Patent: Jun. 9, 2009

(54) PLANAR ANTENNA APPARATUS FOR ULTRA WIDE BAND APPLICATIONS

(75) Inventors: Mohamed Ratni, Esslingen (DE); Dragan Krupezevic, Stuttgart (DE)

(73) Assignee: Sony Deutschland GmbH, Berlin (DE)

( * ) Notice: Subject to any disclaimer, the term of this patent is extended or adjusted under 35 U.S.C. 154(b) by 337 days.

(21) Appl. No.: 11/529,371

(22) Filed: Sep. 29, 2006

(65) Prior Publication Data

US 2007/0103369 A1 May 10, 2007

(30) Foreign Application Priority Data

Nov. 9, 2005 (EP) ..... 05024462

(51) Int. Cl.
*H01Q 9/38* (2006.01)

(52) U.S. Cl. ..... 343/830

(58) Field of Classification Search ..... 343/830, 343/846–848, 767–769, 700 MS
See application file for complete search history.

(56) References Cited

U.S. PATENT DOCUMENTS

| | | | | |
|---|---|---|---|---|
| 5,828,340 | A | 10/1998 | Johnson | |
| 6,850,192 | B2 * | 2/2005 | Yeh | 343/700 MS |
| 7,042,401 | B2 * | 5/2006 | Park et al. | 343/700 MS |
| 7,050,013 | B2 * | 5/2006 | Kim et al. | 343/770 |
| 7,116,276 | B2 * | 10/2006 | Lee | 343/700 MS |
| 7,239,283 | B2 * | 7/2007 | Chua | 343/746 |
| 7,324,049 | B2 * | 1/2008 | Myoung et al. | 343/700 MS |
| 7,352,333 | B2 * | 4/2008 | McCorkle | 343/767 |
| 2005/0156788 | A1 | 7/2005 | Lin | |

FOREIGN PATENT DOCUMENTS

| | | | |
|---|---|---|---|
| DE | 197 29 664 | A1 | 2/1999 |
| EP | 1 564 842 | A1 | 8/2005 |
| JP | 2003-115714 | | 4/2003 |
| WO | WO 2005/062422 | A1 | 7/2005 |

* cited by examiner

*Primary Examiner*—Huedung Mancuso
(74) *Attorney, Agent, or Firm*—Oblon, Spivak, McClelland, Maier & Neustadt, P.C.

(57) ABSTRACT

The present invention relates to the field of microwave antenna and particularly to transmitting and receiving planar antenna design having an omni-directional radiation pattern for ultra wideband (UWB) applications. The object is to provide a planar antenna design for UWB system which is capable of transmitting/receiving microwave signals within the UWB frequency band, capable of a simple planar feeding and a printed low-cost manufacturing antenna, achieves a significant cost reduction by simultaneously applying antenna layout prints while manufacturing classical radio frequency (RF) front-end chip circuits and capable to cope with symmetrical omni-directional transmitting/receiving signals. It is solved by an antenna apparatus for a wireless electronic equipment operable to transmit and/or receive electromagnetic waves in ultra wideband technology comprising at least one radiator device operable to transmit and/or receive an electromagnetic wave, a ground plane device operable to reflect an electromagnetic wave transmitted and/or received by the radiator device and a feeding device) operable to supply signals from and/or to the radiator device, characterised in that the radiator device and the ground plane device are arranged along a common symmetry axis and are planar on the same plane, whereby the radiator device tapers towards the ground plane device.

21 Claims, 5 Drawing Sheets

PLANAR ANTENNA APPARATUS FOR ULTRA WIDE BAND APPLICATIONS

Figure 1:
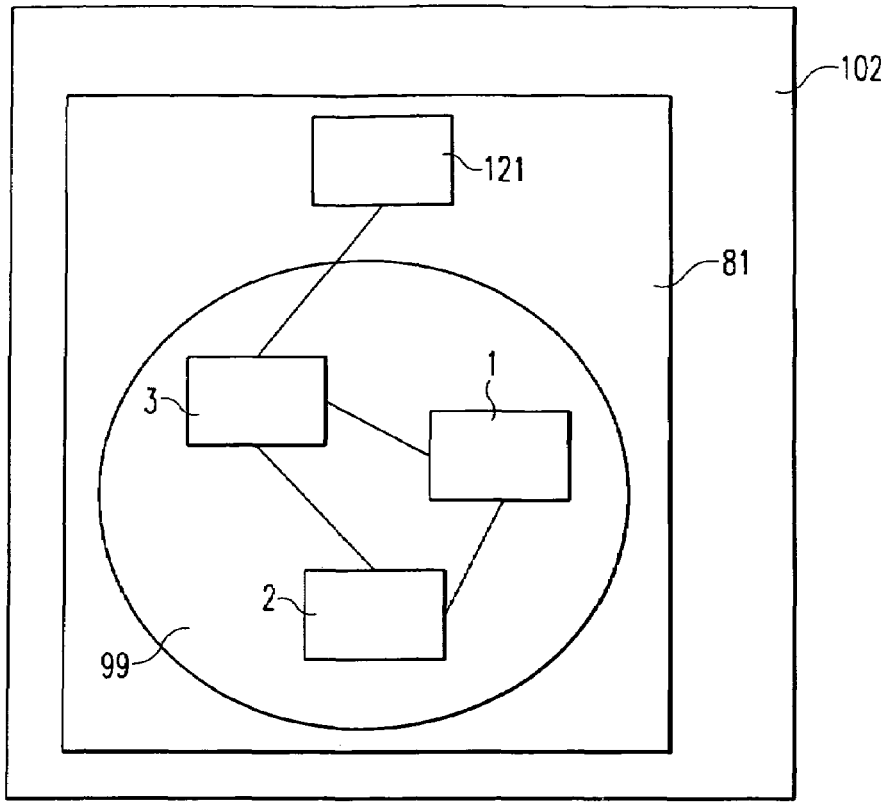

The present invention relates to the field of microwave antenna and particularly to transmitting and receiving planar antenna design having an omni-directional radiation pattern for ultra wideband (UWB) applications.

UWB communication system generally covers a frequency range between 3.1 GHz and 10.6 GHz. According to the IEEE 802.15 Working Group for Wireless Personal Area Networks (see e.g. http://www.ieee802.org/15/) the 802.15 WPAN™ effort focuses on the development of Personal Area Networks or short distance wireless networks. These WPANs address wireless networking of portable and mobile computing devices such as PCs, Personal Digital Assistants (PDAs), peripherals, cell phones, pagers, and consumer electronics; allowing these devices to communicate and interoperate with one another.

It is well known in physics that the size of a microwave antenna is inversely proportional to the frequency of transmission/reception. Therefore, the smaller the antenna size, the lower the antenna efficiency and the narrower is the bandwidth. Thus, as new wireless applications move up in frequency due to the need for an increase bandwidth, their antennas decrease in size correspondingly. This natural size reduction, however, is no longer sufficient to fulfill consumer electronic products specifications. For this reason, antenna structures are more and more becoming customised components, unique to each wireless manufacturer's performance, size and cost requirements. This evolution is being driven by new radio applications and services, which call for antennas that are able to provide a wider channel bandwidth in order to satisfy the ever-increasing demands for high data rates.

Usually, microwave antennas are specified according to a set of parameters including operating frequency, gain, voltage standing wave ratio (VSWR), antenna input impedance and bandwidth. For instance, if the VSWR should not exceed 2, otherwise, a fraction of energy will be reflected at the antenna input, which will result in a mismatch with the radio frequency (RF) front end. A matching network placed in between the antenna and the RF front end will resolve this issue and minimise mismatch loss, but on the other hand this will affect other RF characteristics such as gain, and from a design point of view it is not easy to design a matching circuit with a very high bandwidth.

Ultra-wideband (UWB) technology, which was originally developed for ground-penetrating radar (GPR) applications, came into use as a result of researchers' efforts for detecting and locating surface-laid and shallow-buried targets, e.g. anti-personal landmines. With the development of RF electronics the initial desire to discriminate between two closely flying airplanes changed to the quest for constructing a three-dimensional image of a radar target. The potential for direct reduction of the incident pulse duration was soon exhausted and followed by a detailed analysis of target-reflected signals. It became clear that the most important changes in a target response occurred during a transient process with the duration of one or two oscillations. This fact in itself led to the idea of using UWB signals of this duration without energy expenditure for steady oscillation transmission.

Today, UWB systems are e.g. used as a wireless radio frequency (RF) interface between mobile terminals (laptops and consumer electronics) with much higher data rates than Bluetooth or IEEE 802.11a. A UWB communication system can further be used as an integrated system for automotive in-car services, e.g. for downloading driving directions from a PDA or laptop for use by a GPS-based on-board navigation system, as an entertainment system or any location-based system, e.g. for downloading audio or video data for passenger entertainment and the applications can be more. Ultra-wideband antennas are employed in a wide variety of applications today. Lot of wireless communication system are employing a variety of wideband antenna, but most of these antennas are multi-band but narrow band (around 5-10% bandwidth). For example, mobile phones and wireless handsets are equipped with monopole antennas. One of the most common λ4 monopole antennas is the so-called whip antenna, which can operate at a range of frequencies. However, a monopole antenna also involves a number of drawbacks. Monopole antennas are relatively large in size and protrude from the handset case in an awkward way. The problem with a monopole antenna's obstructive and space-demanding structure complicates any efforts taken to equip a mobile terminal with several antennas to enable multi-band or ultra wideband operation.

There are a wide variety of UWB antenna structures which are being investigated to deal with the bandwidth deficiencies of the common λ/4 antenna, many of these methods being based on 3D UWB antenna but some are based on microstrip design.

Based on the state of the art, different approaches have been investigated in order to meet advanced requirements of designing low-cost solutions for high-performance broadband microwave antennas with a reduced size and a significantly improved performance. These microwave antennas achieve higher gain, make multiple-band operation possible and provide wider bandwidths to satisfy the ever-increasing demands for data rates of mobile applications. Since these requirements involve complex design problems, wireless device manufacturers are realising that antenna solutions based on conventional technologies are no longer sufficient.

In the invention described in US 2002/0053994 A1 refers to a planar UWB antenna with an integrated electronic circuitry. The antenna comprises a first balance element, which is connected to a terminal at one end. A second balance element is connected to another terminal at another end. Thereby, said second balance element has a shape which mirrors the shape of the first balance element such that there is a symmetry plane where any point on the symmetry plane is equidistant to all mirror points on the first and second balance element.

The main raison of designing a planar antenna for UWB system are:

- To have antenna capable of transmitting/receiving microwave signals within the UWB frequency band.
- To have the capability of a simple planar feeding and a printed low-cost manufacturing antenna,
- To achieve a significant cost reduction by simultaneously applying the core substrate of the RF front-end chip as a substrate for the antenna, which means that antenna prints could simultaneously be manufactured by using the layout procedure for classic RF front-end chip circuits.
- To have the capability, to cope with symmetrical omni-directional transmitting receiving signals.

In view of the explanations mentioned above, it is the object of the invention to propose a design for an ultra wideband antenna (for example, but not necessary limited to a frequency range between 3.1 GHz and 10.6 GHz) that fulfill the UWB standard specifications. This object is achieved by an antenna apparatus for wireless electronic equipment operable to transmit and/or receive electromagnetic waves in ultra wideband technology comprising at least one radiator device operable to transmit and/or receive an electromagnetic wave, a ground plane device operable to reflect an electromagnetic wave transmitted and/or received by the radiator device and an feeding device operable to supply signals from and/or to the radiator device, characterised in that the radiator device and the ground plane device are arranged along a common symmetry axis and are planar on the same plane whereby the radiator device tapers towards the ground plane device. Advantageous features are defined in the subordinate claims.

Advantageously a gap is provided between the radiator device and the ground plane device.

Advantageously the radiator device and the ground plane device are formed via etching copper.

Advantageously the radiator device and the ground plane device are formed on the same dielectric substrate of a printed circuit board.

Advantageously the feeding device is arranged along the common symmetry line between the radiator device and the ground plane device.

Advantageously the feeding device is planar.

Advantageously the feeding device comprises a coaxial connection.

Advantageously the feeding device comprises a microstrip line.

Advantageously the radiator device and the ground plane device are arranged on a first plane and the feeding device is arranged on a second plane.

Advantageously the ground plane device comprises a relatively high surface impedance to electromagnetic waves.

Advantageously said antenna apparatus has an overall size of less than 35*22 mm.

Advantageously the ground plane device comprises two slopes which form a sink which faces the radiator device.

Advantageously the surface covered by the radiator device is smaller than the surface covered by the ground plane device.

Advantageously said ground plane device comprises two perpendicular symmetry axis, and wherein said antenna apparatus comprises two radiator devices axially symmetrically arranged with the ground plane device.

Advantageously the radiator device comprises two tapered portions wherein said tapered portions comprise at least a part of the radiator device's sides.

Advantageously the tapered portions and the ground plane device form gaps wherein said gaps narrow towards the symmetry axis.

Advantageously the tapered portions are straight.

Advantageously the tapered portions are curved.

Advantageously the radiator device is curved truncated on top.

Advantageously the radiator device comprises a symmetrically aligned gap operable to suppress the transmission and/or the reception of an electromagnetic wave at a predefined notch frequency whereby the length of the gap depends on the predefined notch frequency.

Advantageously the gap is formed as an arc.

Advantageously the radiator device comprises two extensions wherein the extensions are operable to form the gap with the ground plane device.

Advantageously the width perpendicular to the common symmetry axis of the radiator device is shorter than the one of the ground plane device.

Advantageously a radio frequency device comprising an antenna apparatus is operable to transmit and/or receive an electromagnetic wave and process the electromagnetic wave into data or vice versa.

The present invention is basically dedicated to two kind of two-dimensional (2D) designs for the radiation element of a monopole antenna with a symmetrical omni-directional radiation pattern for transmitting and/or receiving microwave signals within a predetermined bandwidth of operation, which is connectable e.g. to the analogue front-end circuitry of a wireless RF transceiver. The monopole antenna can e.g. be operated in the frequency range between 3.1 and 10.6 GHz.

Figure 2:
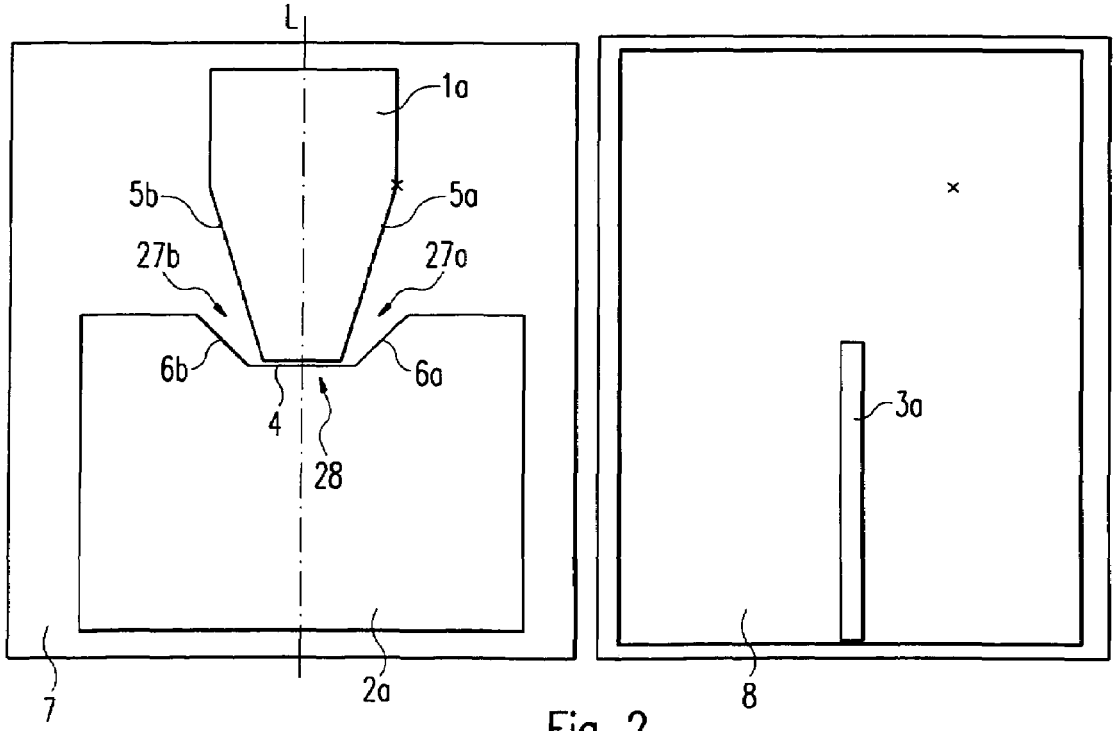
Figure 3:
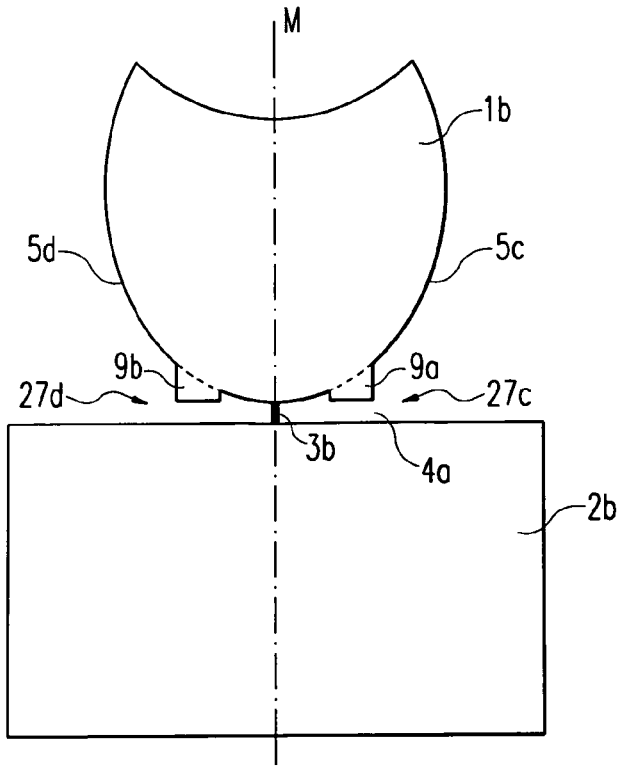
Figure 4:
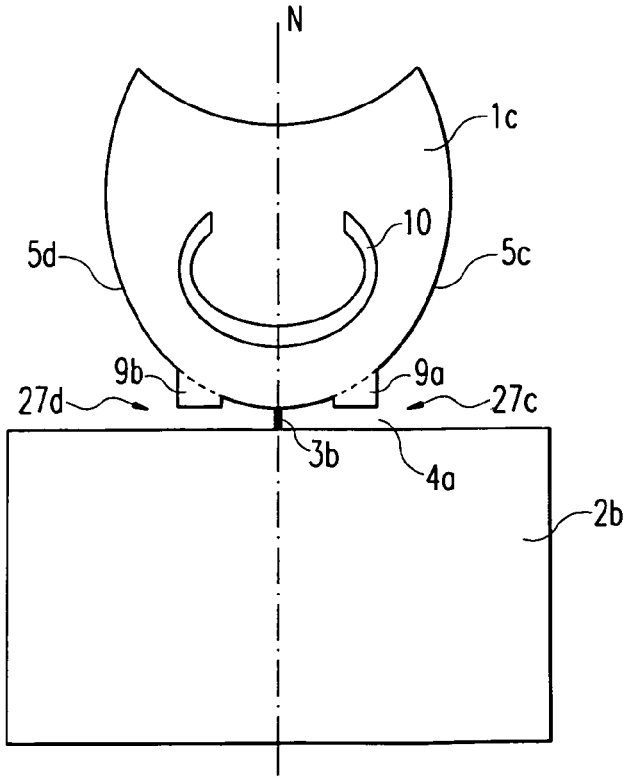
Figure 5:
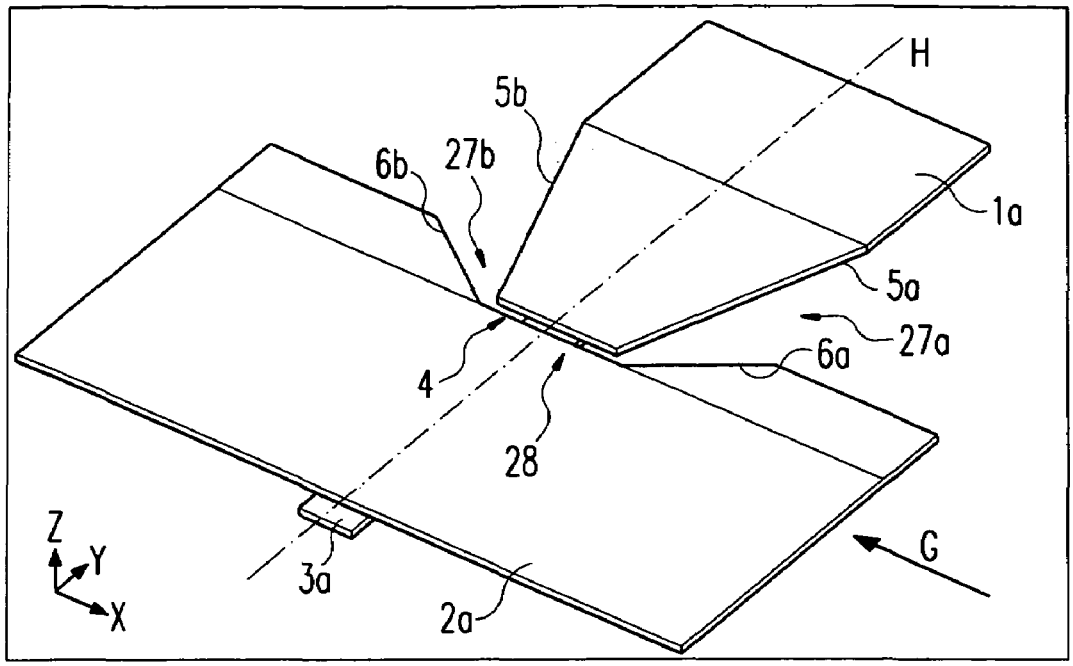
Figure 6:
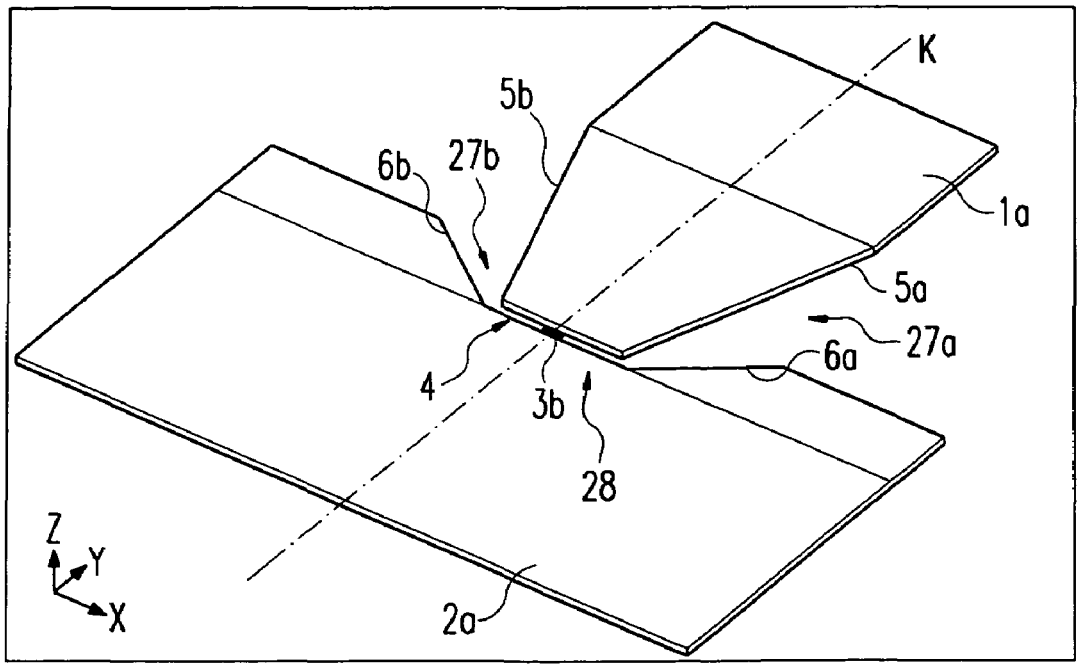
Figure 7:
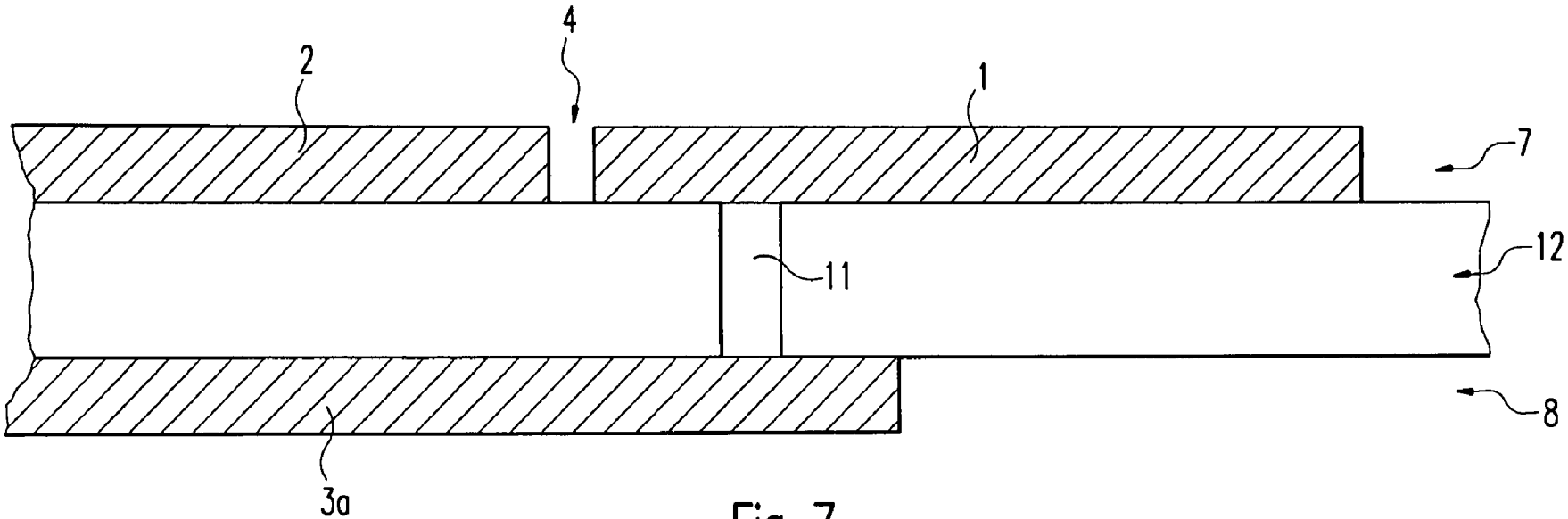
Figure 8:
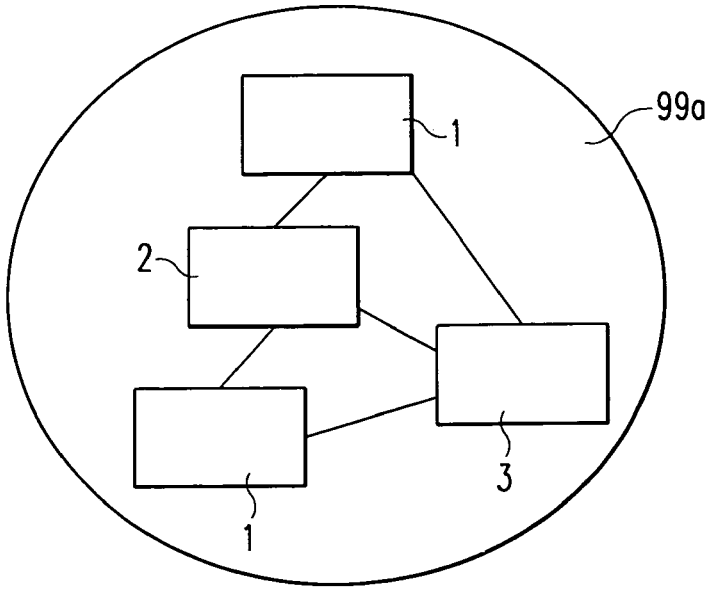
Figure 9:
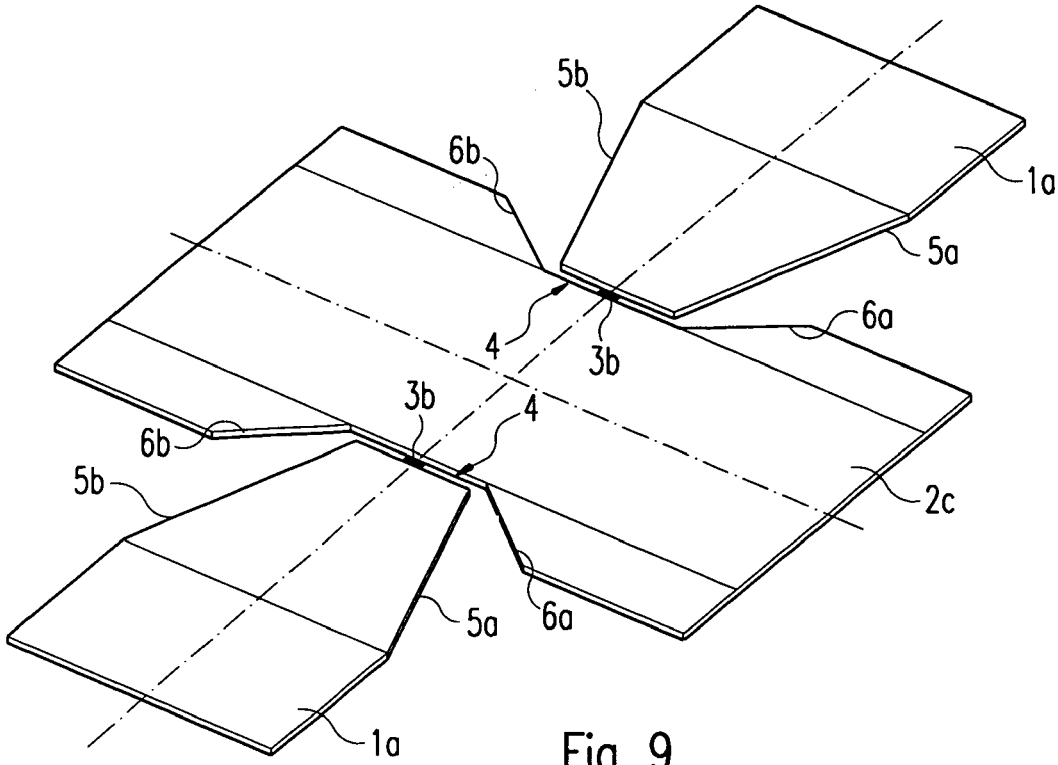

In the following description the invention will be explained in more detail in relation to the enclosed drawings, in which FIG. 1 shows a schematical view of an example of an electronic device comprising an embodiment of an antenna apparatus of the present invention, FIG. 2 shows an example of a layout of the printed circuit board (PCB) of the present invention, FIG. 3 shows an embodiment of the antenna apparatus of the present invention, FIG. 4 shows an alternative embodiment of an antenna apparatus of the present invention, FIG. 5 shows an alternative embodiment of an antenna apparatus of the present invention, FIG. 6 shows an alternative embodiment of an antenna apparatus of the present invention, FIG. 7 shows a cross section of an embodiment of an antenna apparatus of the present invention, FIG. 8 shows a schematical view of an alternative embodiment of an antenna apparatus of the present invention, FIG. 9 shows an alternative embodiment of an antenna apparatus based on the schematical view of FIG. 8.

FIG. 1 shows a schematical view of an example of an electronic device 102 comprising an embodiment of an antenna apparatus 99 of the present invention wherein the antenna apparatus 99 comprises a radiator device 1, a ground plane device 2 and a feeding device 3. FIG. 3 shows a concrete embodiment of the antenna apparatus 99. Furthermore the electronic device 102 comprises a radio frequency (RF) transceiver and/or emitter 81 and the radio frequency device 81 comprises a radio frequency front-end 121 and the antenna apparatus 99.

The electronic device 102 is operable to execute a divers number of different electronical tasks and to connect to other electronic devices having a wireless interface.

The RF transceiver and/or emitter 81 is operable to receive and emit electromagnetic waves and to process the waves into data and/or data into signals by processing means like e.g. a processor chip.

The RF front-end 121 is operable to send and/or receive electrical signals via the feeding device 3 to and/or from the antenna apparatus 99. When the RF front-end 121 is located away from the antenna apparatus 99, preferably a coaxial connection is used as a feeding device 3. When the RF front-end 121 is located near the antenna apparatus 99, preferably a microstrip line is used as a feeding device 3. Since a microstrip line is cheaper to produce but has higher gain losses compared to the coaxial connection, the microstrip line is preferable for short distances between the RF front-end 121 and the antenna apparatus 99.

The antenna apparatus 99 is operable to transmit and/or receive an electromagnetic wave at a ultra wideband frequency of e.g. 3.1 GHz to 10.6 GHz, provides an axially symmetrical omni-directional radiation pattern and forms a $\lambda/4$ monopole antenna. The radiation beam itself exhibits a linear vertical polarisation and an amplitude response around 3 dB over the above-mentioned frequency range. There is a return loss of less than −10 dB within the above-mentioned frequency range which corresponds to a voltage standing wave ratio (VSWR) of less than 2. An electromagnetic field is formed between the radiator device 1 and the ground plane device 2.

The radiator device 1 is operable as a radiation element for transmitting and/or receiving an electromagnetic wave in the ultra wideband frequency. There are different examples explained later how to implement this radiator device but eventually it is axially symmetrical and tapers towards the center of the ground plane device 2 which is described later.

The ground plane device 2 is operable to reflect an electromagnetic wave transmitted and/or received by the radiator device 1 as a reflector with relatively high surface impedance to electromagnetic waves within the frequency bandwidth. There are different examples explained later how to implement this ground plane device 2 but eventually it is axially symmetrical.

The feeding device 3 is operable to supply electrical signals from and/or to the radiator device 1 and to connect the radiator device 1 with the ground plane device 2 in some ways. There are different examples explained later how to implement this feeding device, e.g. as a microstrip line or a coaxial connection. Eventually it conserves the symmetry of the antenna by running along the common symmetry axis of the antenna which starts from the radiator device 1, over the ground plane device 2 and ends in this example in a RF front-end 121.

The radiator device 1, the ground plane device 2 and the feeding device 3 of the antenna apparatus 99 are planar and made by lithographic techniques like etching copper on a dielectric substrate of a printed circuit board (PCB). Eventually any other suitable lithographic techniques known to the person skilled in the art can be used. The antenna structure has e.g. an overall size of less than 35*22 mm. The radiator device 1 and the ground plane device 2 are arranged on one plane like e.g. on one layer of the dielectric substrate of a PCB. Depending on the implementation of the feeding device 3 it is arranged either on a second plane as a microstrip line or on the same plane like the radiator device 1 and the ground plane device 2 as a coaxial connection. The radiator device 1, the ground plane device 2 and the feeding device 3 have a common symmetry axis; thus the devices are axially symmetrical. Furthermore the common symmetry axis crosses through (or at least touches) the areas of the devices.

FIG. 2 shows an example of a layout of a printed circuit board (PCB) of the present invention whereby on the left side a top layer layout 7 and on the right side a bottom layer layout 8 is visible.

The top layer layout 7 comprises an example of the shape of a radiator device 1*a* and the shape of a ground plane device 2*a*. The radiator device 1*a* and the ground plane device 2*a* have the same functions as described in FIG. 1. The radiator device 1*a* and the ground plane device 2*a* have a common symmetry axis L. There is a gap 4 located between the radiator device 1*a* and the ground plane device 2*a*. The gap 4 is parallel and is arranged perpendicular to the symmetry axis L. The gap 4 is open to the sides which face the slopes 6*a* & 6*b* of the ground plane device 2*a*. The slopes 6*a* & 6*b* form a kind of sink 28 on the top side of the rectangular shaped ground plane device 2a wherein the radiator device 1*a* is perpendicularly arranged and the gap 4 is formed. The slopes 6*a* & 6*b* are directed towards the center and the symmetry axis of the ground plane device 2*a*. The radiator device 1*a* comprises two portions 5*a* & 5*b* which taper axially symmetrical towards the ground plane device 2*a*; specifically towards the direction to a point which is located along the common symmetry axis L and inside the area of the ground plane device 2*a*. An alternative is a point outside the area where the portions 5*a* & 5*b* of the radiator device may taper to. These portions 5*a* & 5*b* taper straight, but can be also curved shaped or in any other way. They comprise at least a part of the side of the ground plane device 2*a* parallel to the symmetry axis L. The slopes 6*a* & 6*b* are facing the tapered portions 5*a* & 5*b*, respectively. The slopes 6*a* & 6*b* are straight, but can be formed in any other way e.g. curved, too. The slopes 6*a* & 6*b* and the tapered portions 5*a* & 5*b* are arranged opposite of each other, respectively, and form two gaps 27*a* & 27*b* . The gaps 27*a* & 27*b* narrow axially symmetrical towards the ground plane device 2*a*; specifically towards the direction to a point which is located along the common symmetry axis L and inside the area of the ground plane device 2*a*. An alternative is a point outside the area where the gaps 27*a* & 27*b* may narrow to. The longest width of the radiator device 1*a* perpendicular to the common symmetry axis L is shorter than the width of the ground plane device 2*a* perpendicular to the common symmetry axis L. An alternative may be, that the width of the radiator device 1*a* is equal or longer than the width of the ground plane device 2*a*. The surface covered by the radiator device 1*a* is smaller than the surface covered by the ground plane device 2*a*. An alternative might be an equal or bigger area of the radiator device 1*a* than the one of the ground plane device 2*a*.

The bottom layer layout 8 comprises the shape of an example of a feeding device 3*a*.

The feeding device 3*a* has the same functions as the feeding device 3 in FIG. 1. The feeding device 3*a* comprises a microstrip line which goes straight along the symmetry axis L when bottom and top layer 8 & 7 are placed upon each other. The microstrip line 3*a* extends from the radiator device 1*a* to at least the bottom of the ground plane device 2*a*. The form of the microstrip line 3*a* has to be axially symmetrical to the symmetry axis L. The microstrip line's 3*a* width is smaller than the width of the radiator device 1*a* which faces the gap 4. Alternative implementations of the microstrip line 3*a* which vary from the described format are known to a person skilled in the art. The microstrip line 3*a* is operable to feed the antenna apparatus 99 with electrical signals and is using the ground plane device 2*a* of the antenna apparatus 99 also as a ground for the feeding. The microstrip line 3*a* is connected with the radiator device 1*a* at one end by means of e.g. a via hole described later and the other end with a radio frequency (RF) front-end 121 described in FIG. 1, if a RF device's front-end is near the antenna apparatus 99. The microstrip line 3*a* is normally used when the RF device is setup on the same PCB and near to the antenna apparatus 99.

FIG. 3 shows an embodiment of the present invention wherein an antenna apparatus 99 comprises a ground plane device 2*b*, a radiator device 1*b* and a feeding device 3*b*.

The antenna apparatus 99 has the same functions as in FIG. 1.

The radiator device 1*b* comprises two radiator extensions 9*a* & 9*b*. The radiator device 1*b* has a symmetry axis M and is elliptically shaped and curved truncated on the top.

The radiator device 1*b* can be also circular shaped or have any other curved shape form. The radiator extensions 9*a* & 9*b* each comprise a rectangular side and are aligned with the radiator device 1*b*. The radiator extensions 9*a* & 9*b* sides are parallel to each other and are aligned axially symmetrical to the radiator device 1*b*. The radiator extensions 9*a* & 9*b* bottom side is in line with the edge of the elliptically shaped radiator device 1*b* which is closest to the ground plane device 2*b* and is also aligned parallel to the ground plane device 2*b*. Thus due to the arrangement of the extensions 9*a* & 9*b* and the edge of the ground plane device 2*b* which is opposite of the extensions 9*a* & 9*b* a small, parallel gap 4*a* is formed. The radiator device 1*b* is operable as described in FIG. 1. The two portions 5*c* & 5*d* eventually taper towards the ground plane device 2*b* like in FIG. 2 but are curved shaped in this alternative embodiment. Two gaps 27*c* & 27*b* are formed between the top side of the ground plane device 2*b* and the two tapered portions 5*c* & 5d, respectively. The gaps 27*c* & 27*b* narrow axially symmetrical towards the ground plane device 2*b* and towards the symmetry axis M.

The ground plane device 2*b* comprises a rectangular shaped area with two perpendicular symmetry axis where one of them is common to the symmetry axis M. The area of the ground plane device 2*b* is larger than the one of the radiator device 1*b* with its extensions 9*a* & 9*b*. The ground plane device 2*b* is operable as described in FIG. 1. An alternative ground plane device might be shaped and arranged like the one (2*a*) of FIG. 2 which comprises a sink (28).

The feeding device 3*b* comprises a connection between the radiator device 1*b* and the ground plane device 2*b* and is arranged along the common symmetry axis M of the ground plane device 2*b* and the radiator device 1*b*. The feeding device 3*b* is formed as a coaxial connection but can be implemented as microstrip line or any other way known to a person skilled in the art. The coaxial connection can be implemented as a coaxial cable. The feeding device 3*b* is operable as described in FIG. 1.

The radiator device 1*b* and the ground plane device 2*b* are aligned together forming a common symmetry axis M. Except for a gap 4*a* formed between the two extensions 9*a* & 9*b*, the edge of the radiator device 1*b* and the ground plane device 2*b*, the radiator extensions 9*a* & 9*b* are aligned with the top side of the ground plane device 2*b*.

FIG. 4 shows an alternative embodiment of the present invention wherein an antenna apparatus 99 comprises a ground plane device 2*b*, a radiator device 1*c* and a feeding device 3*b*.

The antenna apparatus 99 comprising the ground plane device 2*b*, the radiator device 1*c* and the feeding device 3*b* is the same as in FIG. 3, respectively. The radiator extensions 9*a* & 9*b* are the same as in FIG. 3, respectively.

Advantageously the radiator device 1*c* comprises an additional slit 10 shaped as an arc which is axially symmetrically aligned to the symmetry axis N of the radiator device 1*c*. This structure is dedicated for omitting the transmission and reception of an electromagnetic wave at a predefined wavelength λ or notch frequency f, respectively, whereby the length of the slit 10 depends on said predefined wavelength λ or notch frequency f, respectively. The slit 10 can have any other axially symmetrical form suitable to omit a specific frequency which depends on the length of the slit. This antenna apparatus 99 can have a frequency notch at any frequency e.g. within 3.1 GHz to 10.6 GHz for transmitting and/or receiving an electromagnetic wave. The antenna arc slit 10 length can be calculated using the formula in (2).

Advantageously the radiator device 1*b* of FIG. 2 may comprise also an additional slit 10 which is axially symmetrically aligned to the symmetry axis L of the radiator device 1*b*. The functions of the slit 10 are the same as described above.

$$l\ [\text{mm}] = \frac{75}{f\ [\text{GHz}]} \tag{2}$$

FIG. 5 shows an alternative embodiment of the present invention wherein an antenna apparatus 99 comprises a ground plane device 2*a*, a radiator device 1*a* and a feeding device 3*a*. The ground plane device 2*a*, the radiator device 1*a*, the feeding device 3*a* and the antenna apparatus 99 are the same as described in FIG. 2.

The radiator device 1*a* comprises two tapered portions 5*a* & 5*b* and is the same as in FIG. 2.

The ground plane device 2*a* comprises two slopes 6*a* & 6*b* and is the same as in FIG. 2.

The feeding device 3*a* is planar on a second plane and comprises a microstrip line 3a which begins under the radiator device 1*a* and cross under the ground plane device 2*a* as described in FIG. 2. The microstrip line 3*a* is connected with the radiator device 1*a* at one end by means of e.g. a via hole described later and the other end with the radio frequency (RF) front-end as described in FIG. 1. This microstrip line is used when the RF device front-end is near the antenna apparatus 99. The feeding device 3*a* is located along the symmetry axis H.

The radiator device 1*a* and the ground plane device 2*a* have a common symmetry axis H. The radiator device 1*a* and the ground plane device 2*a* are arranged on a first plane and the feeding device 3*a* is arranged on a second plane. The area of the radiator device 1*a* is smaller than the area of the ground plane device 2*a*.

FIG. 6 shows an alternative embodiment of the present invention wherein an antenna apparatus 99 comprises a ground plane device 2*a*, a radiator device la and a feeding device 3*b*. The ground plane device 2*a* and the radiator device la are the same as described in FIG. 5, respectively. The antenna apparatus 99 and the feeding device 3*b* have the same functions as described in FIG. 1.

The feeding device 3*b* comprises a coaxial connection between the radiator device 1*a* and the ground plane device 2*a*. The feeding device 3*b* is located along the common symmetry axis K of the radiator device 1*a* and the ground plane device 2*a*. The feeding device 3*b* is connected with the centre of the side of the radiator device 1*a* which faces the top of the ground plane device 2*a* and with the centre of the side of the ground plane device 2*a* which faces the radiator device 1*a*. The coaxial connection can be also implemented as a coaxial cable soldered to the radiator device 1*a* along the symmetry axis K and to the ground plane device 2*a* along the symmetry axis K. The coaxial connection is normally used to connect to the RF device front-end 121 (as described in FIG. 1) since it is further away compared to the alternative embodiment like FIG. 5 using a microstrip line.

FIG. 7 shows a cross section of an embodiment of an antenna apparatus 99 of the present invention comprising a ground plane device 2 and a radiator device 1 on a top layer 7, a feeding device 3*a* on a bottom layer 8 and a via hole 11 between the top and bottom layer of a substrate 12. The ground plane device 2 and the radiator device 1 on the top layer 7 are the same as in FIG. 2, 3 or 4, respectively. And the feeding device 3*a* on the bottom layer 8 is the same as in FIG. 2 or 5, respectively.

The substrate 12 comprises the two layers 7 & 8 and is operable as a dielectric spacer. The feeding device 3*a* comprises a microstrip line. The cross section is examined in the direction of the arrow G in FIG. 5 and runs along the symmetry line H of the antenna apparatus 99 of FIG. 5 through the via hole 11 of FIG. 7. The thickness of the substrate is chosen in such a way to be suitable to form a conduit for an electromagnetic field between the feeding device 3*a* and the ground plane device 2 and the radiator device 1.

The via hole 11 is a tube which is either metallically coated or filled out to form an electrical connection between the first layer and the second layer. The profile of the via hole 11 is a circle but can be chosen any form suitable for the best conductive characteristics. The via hole 11 connects one end of the microstrip line 3*a* from the second layer 8 to the first layer 7 through the substrate 12 to the radiator device 1. The other end of the microstrip line 3*a* is connected with a RF device front-end 121 as described in FIG. 1.

The gap 4 is the same as described in FIG. 2.

FIG. 8 shows a schematical view of an alternative embodiment of an antenna apparatus 99*a* of the present invention comprising two radiator devices 1, one ground plane device 2 and a common feeding device 3. The radiator devices 1, the ground plane device 2 and the feeding device 3 are the same as in FIG. 1, respectively.

The antenna apparatus 99*a* is forming a dipole antenna. The two radiator devices 1 are aligned on a common symmetry line and on the opposite side of the ground plane device 2, respectively. The radiator devices 1 are attached to the ground plane device 2 via the feeding device 3. Thus the previously from FIG. 1 known λ/4 monopole antenna for the UWB frequency range is now developed to a λ/2 dipole antenna for the UWB frequency range comprising now the characteristics of a λ/2 dipole antenna known to a person skilled in the art. The radiator devices 1 work dependently on each other and function as a whole antenna.

The ground plane device 2 comprises two symmetry axis: one axis coming from the radiator devices 1 going through the middle of the ground plane device 2 and one axis perpendicular to the other axis crossing it in the middle of the ground plane device 2. The feeding device 3 is the same as in FIG. 1 but now transmits signals to and/or from both radiator devices 1, too. The feeding device 3 is connected to the radiator devices 1 and the ground plane device 2 and the RF device front-end 121 described in FIG. 1.

FIG. 9 shows an alternative embodiment of an antenna apparatus 99*a* comprising two radiator devices 1 a, a ground plane device 2*c* and a feeding device 3*b* of an antenna apparatus 99*a* of the present invention. The antenna apparatus 99*a* has the same functions as in FIG. 8. The radiator devices 1*a* have the same shape and functions as described in FIG. 6 but can also be as described in FIG. 2, 3, 4 or 5, respectively. The ground plane device 2*c* has the same functions as in FIG. 8 and derives from the ground plane device 2*a* of FIG. 2, 5 or 6 but can also be formed from FIG. 3 or 4. The feeding device 3*b* is implemented as coaxial connection but can be connected e.g. as a microstrip line or in any other way known to a person skilled in the art. The feeding device 3*b* has the same functions as in FIG. 8.

The invention claimed is:

1. An antenna apparatus for a wireless electronic equipment configured to transmit and/or receive electromagnetic waves in ultra wideband technology comprising:

at least one radiator device configured to transmit and/or receive an electromagnetic wave, a ground plane device configured to reflect an electromagnetic wave transmitted and/or received by the radiator device, and a feeding device configured to supply signals from and/or to the radiator device, wherein the radiator device and the ground plane device are arranged along a common symmetry axis and are planar on the same plane, whereby the radiator device tapers towards the ground plane device, wherein the feeding device includes a microstrip line, the radiator device and the ground plane device are arranged on a first plane, and the feeding device is arranged on a second plane.

2. An antenna apparatus for a wireless electronic equipment according to claim 1, wherein a gap is provided between the radiator device and the ground plane device.

3. An antenna apparatus for a wireless electronic equipment according to claim 1, wherein the radiator device and the ground plane device are formed via etching copper.

4. An antenna apparatus for a wireless electronic equipment according to claim 1, wherein the radiator device and the ground plane device are formed on the same dielectric substrate of a printed circuit board.

5. An antenna apparatus for a wireless electronic equipment according to claim 1, wherein the feeding device is arranged along the common symmetry axis between the radiator device and the ground plane device.

6. An antenna apparatus for a wireless electronic equipment according to claim 1, wherein the feeding device is planar.

7. An antenna apparatus for a wireless electronic equipment according to claim 1, wherein the ground plane device includes a relatively high surface impedance to electromagnetic waves.

8. An antenna apparatus for a wireless electronic equipment according to claim 1, wherein said antenna apparatus has an overall size of less than 35*22 mm.

9. An antenna apparatus for a wireless electronic equipment according to claim 1, wherein the ground plane device includes two slopes which form a sink which faces the radiator device.

10. An antenna apparatus for a wireless electronic equipment according to claim 1, wherein the surface covered by the radiator device is smaller than the surface covered by the ground plane device.

11. An antenna apparatus for a wireless electronic equipment according to claim 1, wherein said ground plane device includes two perpendicular symmetry axis, and wherein said antenna apparatus includes two radiator devices axially symmetrically arranged with the ground plane device.

12. An antenna apparatus for a wireless electronic equipment according to claim 1, wherein the radiator device includes two tapered portions wherein said tapered portions include at least a part of the radiator device's sides.

13. An antenna apparatus for a wireless electronic equipment according to claim 12, wherein the tapered portions and the ground plane device form a gap wherein said gap narrows towards the symmetry axis.

14. An antenna apparatus for a wireless electronic equipment according to one of claims 12 or 13, wherein the tapered portions are straight.

15. An antenna apparatus for a wireless electronic equipment according to one of claims 12 or 13, wherein the tapered portions are curved.

16. An antenna apparatus for a wireless electronic equipment according to claim 15, wherein the radiator device is curved truncated on top.

17. An antenna apparatus for a wireless electronic equipment according to claim 2, wherein the radiator device includes two extensions wherein the extensions are configured to form the gap with the ground plane device.

18. An antenna apparatus for a wireless electronic equipment according to claim 1, wherein the width perpendicular to the common symmetry axis of the radiator device is shorter than the one of the ground plane device.

19. An antenna apparatus for a wireless electronic equipment according to claim 1, wherein the radiator device includes a common symmetry axis symmetrically aligned slit configured to suppress the transmission and/or the reception of an electromagnetic wave at a predefined notch frequency whereby the length of the slit depends on the predefined notch frequency.

20. An antenna apparatus for a wireless electronic equipment according to claim 19, wherein the slit is formed as an arc.

21. A radio frequency device comprising an antenna apparatus according to claim 1, wherein the radio frequency device is configured to transmit and/or receive an electromagnetic wave and process the electromagnetic wave into data or vice versa.

* * * * *